US008235742B2

(12) United States Patent
Komiyama et al.

(10) Patent No.: US 8,235,742 B2
(45) Date of Patent: Aug. 7, 2012

(54) CONNECTOR WITH SLIDING CAM

(75) Inventors: Ryuichi Komiyama, Tokyo (JP); Kazushige Sakamaki, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/218,011

(22) Filed: Aug. 25, 2011

(65) Prior Publication Data

US 2011/0312198 A1 Dec. 22, 2011

Related U.S. Application Data

(63) Continuation of application No. PCT/JP2009/051507, filed on Feb. 3, 2010.

(30) Foreign Application Priority Data

Feb. 27, 2009 (JP) ..... 2009-045572

(51) Int. Cl.
*H01R 13/625* (2006.01)

(52) U.S. Cl. ..... 439/347; 439/157; 439/372

(58) Field of Classification Search ..... 439/157, 439/372, 347
See application file for complete search history.

(56) References Cited

U.S. PATENT DOCUMENTS 5,391,086 A * 2/1995 Woller et al. ..... 439/157
5,478,251 A * 12/1995 Jaklin ..... 439/157
5,489,224 A * 2/1996 Schwarz ..... 439/752
5,672,067 A * 9/1997 Ryll et al. ..... 439/157
5,681,175 A * 10/1997 Busse et al. ..... 439/157
5,928,012 A * 7/1999 Kitamura ..... 439/157
6,083,017 A 7/2000 Matsumura
6,142,800 A * 11/2000 Iwahori ..... 439/157
6,168,445 B1 * 1/2001 Seutschniker et al. ..... 439/157
6,171,146 B1 * 1/2001 Fink et al. ..... 439/595
6,193,530 B1 * 2/2001 Sakurai et al. ..... 439/157

(Continued)

FOREIGN PATENT DOCUMENTS

JP 2003-132996 5/2003

OTHER PUBLICATIONS

PCT Notification of Transmittal of Translation of the International Preliminary Report on Patentability dated Sep. 11, 2011, for International Application No. PCT/JP2010/051507, Applicant Tyco Electronics Japan G.K., International Filing Date Feb. 3, 2010, 2 pages.

(Continued)

*Primary Examiner* — Ross Gushi
(74) *Attorney, Agent, or Firm* — Barley Snyder

(57) ABSTRACT

A connector having a sliding cam that prevents twisting when mating with a mating connector. The connector having an inner housing, an inner housing, a slider receiving slot, and a slider. The inner housing includes a contact positioned in the inner housing, while the outer housing is attached to the inner housing. The slider receiving slot is positioned in the outer housing, and the slider includes a plurality of multiple cam grooves with cam pin insertion openings into which a plurality of cam pins positioned along a side surface of a mating connector are inserted. The slider is slidably received in the slider receiving slot. A plurality of temporary mating projections are positioned along the cam pin insertion openings, wherein a height of one of the plurality of temporary mating projections is higher than a height of another of the plurality of temporary mating projections.

11 Claims, 16 Drawing Sheets

U.S. PATENT DOCUMENTS

| | | | | |
|---|---|---|---|---|
| 6,213,795 | B1 * | 4/2001 | Drescher et al. | 439/157 |
| 6,217,354 | B1 * | 4/2001 | Fencl et al. | 439/157 |
| 6,305,957 | B1 * | 10/2001 | Fink et al. | 439/157 |
| 6,345,995 | B1 * | 2/2002 | Bigotto et al. | 439/157 |
| 6,375,481 | B2 * | 4/2002 | Zweigle | 439/157 |
| 6,475,004 | B2 * | 11/2002 | Shuey et al. | 439/157 |
| 6,641,423 | B1 * | 11/2003 | Giro | 439/347 |
| 6,652,298 | B2 * | 11/2003 | Ohnuki | 439/157 |
| 6,666,697 | B2 * | 12/2003 | Yamashita | 439/157 |
| 6,773,279 | B2 * | 8/2004 | Yamashita | 439/157 |
| 6,824,406 | B1 * | 11/2004 | Sharples et al. | 439/157 |
| 6,960,090 | B2 * | 11/2005 | Denter et al. | 439/157 |
| 6,971,894 | B2 * | 12/2005 | Dillon et al. | 439/157 |
| 6,997,725 | B2 * | 2/2006 | Stella et al. | 439/157 |
| 7,070,438 | B2 * | 7/2006 | Dillon | 439/347 |
| 7,303,415 | B2 * | 12/2007 | Tyler | 439/157 |
| 7,351,078 | B2 * | 4/2008 | Winkler et al. | 439/157 |
| 7,407,398 | B2 * | 8/2008 | Shishikura et al. | 439/157 |
| 7,568,925 | B2 * | 8/2009 | Ciriello et al. | 439/157 |
| 7,618,271 | B2 * | 11/2009 | Shiga | 439/157 |
| 7,695,296 | B1 * | 4/2010 | Hitchcock et al. | 439/157 |
| 7,695,297 | B2 * | 4/2010 | Pittenger et al. | 439/157 |
| 7,789,682 | B1 * | 9/2010 | Hitchcock et al. | 439/157 |
| 7,837,485 | B2 * | 11/2010 | Epe et al. | 439/157 |
| 7,938,655 | B2 * | 5/2011 | Komiyama et al. | 439/157 |
| 8,057,245 | B2 * | 11/2011 | Sakamaki et al. | 439/157 |
| 2001/0019908 | A1 * | 9/2001 | Zweigle | 439/157 |
| 2002/0081877 | A1 * | 6/2002 | Ohnuki | 439/157 |
| 2003/0082940 | A1 * | 5/2003 | Yamashita | 439/157 |
| 2003/0109155 | A1 * | 6/2003 | Yamashita | 439/157 |
| 2005/0020114 | A1 * | 1/2005 | Denter et al. | 439/157 |
| 2005/0064749 | A1 * | 3/2005 | Stella et al. | 439/157 |
| 2005/0106911 | A1 * | 5/2005 | Sharples et al. | 439/157 |
| 2005/0221647 | A1 * | 10/2005 | Dillon et al. | 439/157 |
| 2005/0221653 | A1 * | 10/2005 | Dillon | 439/331 |
| 2006/0040536 | A1 * | 2/2006 | Putnam et al. | 439/157 |
| 2008/0214039 | A1 * | 9/2008 | Ciriello et al. | 439/347 |
| 2009/0042423 | A1 * | 2/2009 | Shiga | 439/157 |
| 2009/0221167 | A1 * | 9/2009 | Pittenger et al. | 439/157 |
| 2009/0317993 | A1 * | 12/2009 | Komiyama et al. | 439/157 |
| 2010/0178791 | A1 * | 7/2010 | Komiyama et al. | 439/347 |

OTHER PUBLICATIONS

PCT Written Opinion of the International Searching Authority (English Translation) dated Sep. 3, 2010, for International Application No. PCT/JP2010/051507, Applicant Tyco Electronics Japan G.K., 5 pages.

PCT International Search Report for co-pending International Application No. PCT/JP2010/051507, dated Mar. 9, 2010, 2 page.

* cited by examiner

CONNECTOR WITH SLIDING CAM

CROSS-REFERENCE TO RELATED APPLICATION

This application is a continuation of PCT International Application No. PCT/JP2009/051507 filed Feb. 3, 2010, which claims priority under 35 U.S.C. §119 to Japanese Patent Application No. JP 2009-045572, filed Feb. 27, 2009.

FIELD OF THE INVENTION

The present invention relates to a connector and in particular to a lever-type electrical connector having a sliding cam for reducing an operational force for mating.

BACKGROUND

When connectors having a number of terminals are mated, the mating resistance generated between mating contacts in both of the connectors becomes greater. Hence, it is generally difficult to mate the connectors by pushing the connectors by hand. For this reason, several kinds of what are called lever-type connectors with sliding cams, which utilize a toggle for reducing the operational force for mating, have been proposed.

As connectors of such a type, for example, the connectors shown in FIG. 13 to FIG. 15 are known (see JP 2003-132996 A).

The known connector 101 shown in FIG. 13 is configured to mate with a known mating connector 150, and includes a pair of sliders 102, a lever 130, and a wire cover 140.

As shown in FIG. 14, a contact receiving portion 112 having multiple contact receiving passageways 111 that extend in the front-rear direction (in FIG. 13, the lower side denotes front side and the upper side denotes rear side) is positioned in the housing 110. Each of the contact receiving passageways 111 receives a metal contact (not shown) connected to an electrical wire (not shown). In addition, a pair of upper and lower slider receiving slots 113 (in FIG. 13, the front side in the drawing denotes upper side and the rear side in the drawing denotes lower side) that open at both of left and right end surfaces (in FIG. 13, the left side denotes left side and the right side denotes right side) are defined in the housing 110.

Furthermore, lever receiving grooves 114 that open along the rear surface of the housing 110 are provided in the housing 110 and along the outside of each of the slider receiving slots 113.

In addition, a sealing member 115 is positioned along the outer circumference of the contact receiving portion 112. The sealing member 115 seals the known mating connector 150 that mates with and the contact receiving portions 112. Additionally, the sealing member 115 prevents water from entering from the mating portion side into the contact receiving passageways 111.

Furthermore, each of the sliders 120 is formed to have a plate shape, and is movably received in the slider receiving slot 113. The inner surface of each slider 120 includes a cam groove 121 into which a cam pin 152 positioned along a mating portion 151 of the known mating connector 150 is inserted, as shown in FIG. 13. Also, the outer surface of each slider 120 includes a pin portion 122 that is inserted into an interlocking groove 133, to be described later, positioned on the lever 130.

Moreover, the lever 130 extends in such a manner that a pair of arms 132 each having a plate shape extend from both ends of an operational portion 131. Each of the arms 132 includes a pin opening 134, as shown in FIG. 13. The lever 130 is supported for rotation with respect to the wire cover 140 by making the pin opening 134 fit with a supporting shaft 141 positioned substantially in the middle of the left-right direction of the wire cover 140. Additionally, each of the arms 132 includes the interlocking groove 133 from an outer peripheral edge toward the pin opening 134. Hereinafter, in each of the arms 132, the side on which the operational portion 131 is positioned will be referred to as front side, whereas the side on which the pin opening 134 is positioned will be referred to as rear side.

Furthermore, the wire cover 140 is attached along the rear side of the housing 110 to extend position a bundle of electrical wires extended from the housing 110 to one side in the left-right direction of the housing 110 (to the right side in FIG. 13, to the front side in the drawing in FIG. 14).

In order to assemble the known connector 101 and the known mating connector 150, firstly, the lever 130 and the sliders 120 are arranged at unmated positions, so that the mating portion 151 of the known mating connector 150 mates the front side of the known connector 101. Then, the cam pins 152 of the known mating connector 150 enter the inlets of the cam grooves 121 positioned at the slider 120, so both connectors 110 and 150 are brought into a temporary mating state. Subsequently, when the lever 130 in the unmated position is rotated toward the mated position in an arrow X direction, the interlocking groove 133 positioned at the lever 130 pushes the pin portions 122 of the sliders 120. Thus, the sliders 120 interlock with the lever 130 to move from the unmated position to the mated position. The action of the cam groove 121 and the cam pin 152 causes both of the connectors 101 and 150 to be pulled closer to each other and brought into the mating state. Conversely, when the lever 130 at the mated position is rotated toward the unmated position in the opposite direction to the arrow X direction, the sliders 120 interlock with the lever 130 to move from the mated position to the unmated position. The action of the cam groove 121 and the cam pin 152 separate both of the connectors 101 and 150 from each other.

In this manner, as to the known connector 101, the toggle structure where the lever 130 that rotates and the sliders 120 that interlock with the lever 130 and that has the cam groove 121 is employed. Thus, the mating and unmating operational forces can be reduced considerably.

Moreover, as connectors of such a type, there are disclosed the connector having a projection for temporarily mating the cam pin at each of the inlets of multiple cam grooves, into which the corresponding multiple cam pins are inserted, respectively (see JP H10-255902 A).

In the conventional connector, however, an operator conducts the mating operation between the connector and the mating connector in a situation where the operator is not able to confirm the mating portion visually, in some cases. When the operator conducts the mating operation in such a manner, the lever is rotated with the connector that is obliquely located with respect to the mating portion of the mating connector. This results in twisting during mating, and thus damage may occur to the connector.

Its concrete example will be described below.

In FIG. 16 and FIG. 17, a mating portion 151 of the known mating connector 150 includes three pairs of cam pins 152*a* to 152*c*. The mating portion 151 has a rectangular frame shape, and is composed of: a pair of installed surfaces (side surfaces) 151*a*, opposing each other, provided with the cam pins 152*a* to 152*c*; and a pair of end surfaces 151*b* for coupling the pair of installed surfaces 151*a*. The cam pins 152*a* (hereinafter, referred to as first cam pin) located at the front side of the arm portion 132 of the known connector 101 are spaced away from one of the end surfaces 151*b* by a distance $d_1$. Additionally, the cam pins 152*c* (hereinafter, referred to as third cam pin) located at the rear side of the arm portion 132 of the known connector 101 are spaced away from the other of the end surfaces 151*b* by a distance $d_2$ (where $d_1>d_2$).

As shown in FIG. 16A, when the housing 110 and the mating portion 151 are mated with each other in a state where the known connector 101 is mated with the known mating connector 150 with such a configuration while the known connector 101 is tilting to the rear side of the arm portion 132, there is a possibility that the first cam pins 152*a* are not properly mated with can grooves (hereinafter, referred to as first cam groove) corresponding to the first cam pins 152*a*, as shown in FIG. 16B and FIG. 16C.

On the other hand, as shown in FIG. 17A, when the housing 110 and the mating portion 151 are mated with each other in a state where the known connector 101 is mated with the known mating connector 150 with such a configuration while the known connector 101 is tilting to the front side of the arm portion 132, there is a possibility that the third cam pins 152*c* are not properly mated with cam grooves (hereinafter, referred to as third cam groove) corresponding to the third cam pins 152*c*, as shown in FIG. 17B and FIG. 17C.

When the lever is rotated in the state shown in FIG. 16, so-called twisting during mating occurs. Since the distances from the end surface 151*b* of the mating portion 151 to the first cam pins 152*a* are longer than those to the third cam pins 152*c*, a large amount of stress is applied to the first cam pins 152*a* in which the mating is not certain. There is a possibility of damaging the first cam pins 152*a*.

Meanwhile, when the lever 130 is rotated in a state shown in FIG. 17, further stress is applied to the third cam pins 152*c* in which the mating is not certain. However, since the distances from the end surface 151*b* of the mating portion 151 to the first cam pins 152*a* are shorter than those to the third cam pins 152*c*, the resistance to the rotation of the lever 130 is made larger. For this reason, the operator often notices an abnormality before damaging the third cam pins 152*c*.

In this manner, when the known connector 101 is mated with the known mating connector 150 having plural cam pins, positioned on both ends, with different distances from the end surface 151*b*, there is a possibility of damaging the cam pins with longer distances from the end surface 151*b*. An improvement is needed.

SUMMARY

Accordingly, the present invention has been made in view of the above problems, and an object of the present invention is to provide a connector with a sliding cam that can prevent twisting during the mating with a mating connector.

The connector having an inner housing, an inner housing, a slider receiving slot, and a slider. The inner housing includes a contact positioned in the inner housing, while the outer housing is attached to the inner housing. The slider receiving slot is positioned in the outer housing, and the slider includes a plurality of multiple cam grooves with cam pin insertion openings into which a plurality of cam pins positioned along a side surface of a mating connector are inserted. The slider is slidably received in the slider receiving slot. A plurality of temporary mating projections are positioned along the cam pin insertion openings, wherein a height of one of the plurality of temporary mating projections is higher than a height of another of the plurality of temporary mating projections.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENT(S)

Embodiments of the present invention will now be described with reference to the drawings. In the following description, a connector having a sliding cam according to the present invention will be described with a lever-type connector 1 as an example.

Figure 1:
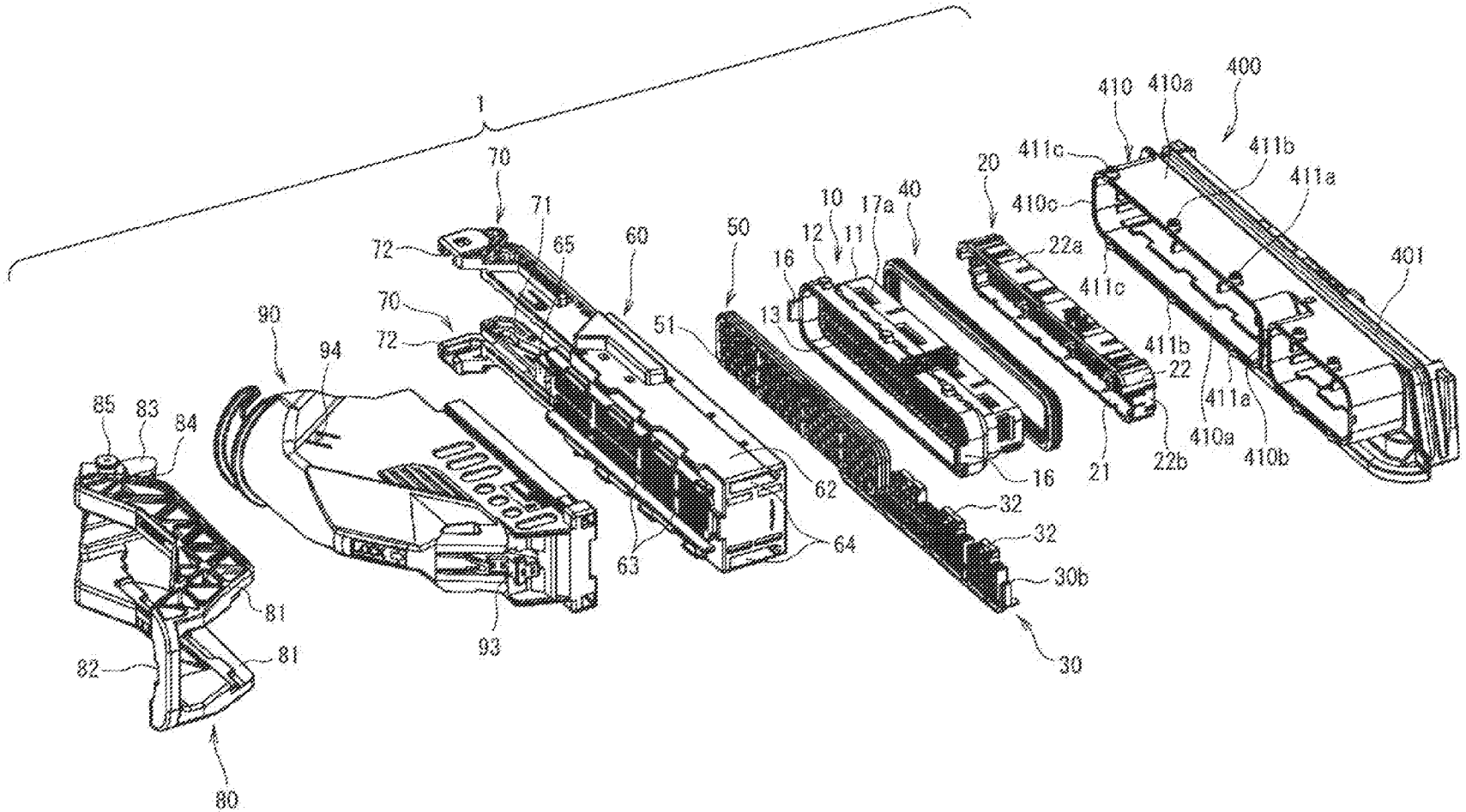
FIG. 1 is an exploded perspective view of a lever-type connector having a sliding cam according to the invention.

The lever-type connector 1 illustrated in FIG. 1 includes an inner housing 10, a front cover 20, a retainer 30, a first sealing member 40, a second sealing member 50, an outer housing 60, a pair of sliders 70, a lever 80, and a wire cover 90.

On the other hand, a mating connector 400 to be mated with the lever-type connector 1 is integrally formed by molding an insulating resin, and has a main body 401 with mating contacts (not illustrated), and a mating portion 410 positioned on the top of the main body 401. Specifically, the mating contacts are secured to the main body 401 to correspond to multiple contact receiving chambers 23 (see FIG. 4 and FIG. 5) positioned at the front cover 20. A mating portion 410 surrounds the mating contacts, and is inserted between the outer periphery of the inner housing 10 of the lever-type connector 1 and the inner periphery of a hood 62 of the outer housing 60. A side surface 410*a* of the mating portion 410 includes three pairs of cam pins 411*a* to 411*c*. The mating portion 410 has a substantially rectangular frame shape, and is composed of: a pair of opposing side surfaces 410*a*, installed surfaces, in which the cam pins 411*a* to 411*c* are provided; and a pair of end surfaces 410*b* and 410*c* coupling the pair of side surfaces 410*a*. Among the cam pins on the both end sides positioned at the side surfaces 410*a*, the first cam pins 411*a* are spaced apart from one of the side surfaces 410*b* by only a distance $d_1$ (see FIG. 8). In addition, the third cam pins 411*c* are spaced apart from the other of the side surfaces 410*c* by only a distance $d_2$ ($d_1>d_2$) (see FIG. 8).

Figure 3A:
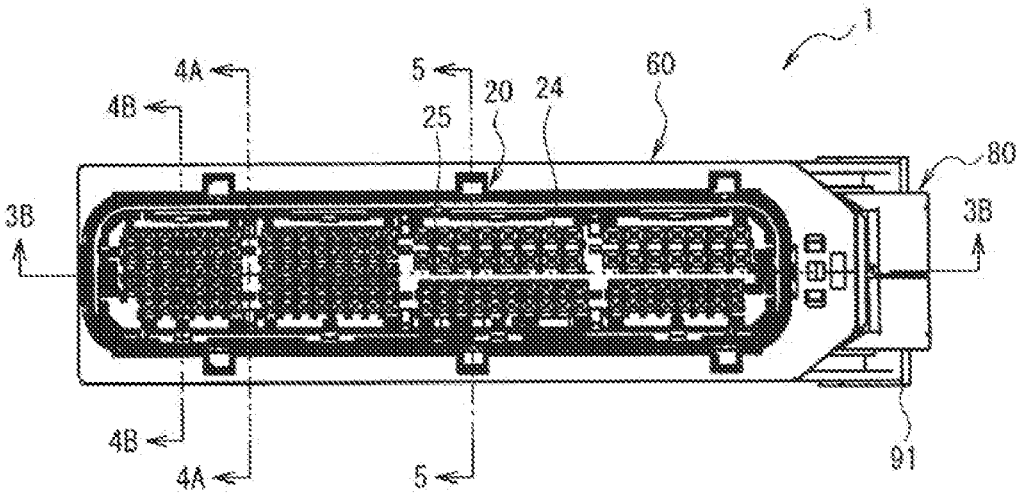
FIG. 3 is a front view of the lever-type connector of FIG. 1.
FIG. 3B is a cross-sectional view taken along a line 3B-3B of FIG. 3A.
Figure 3B:
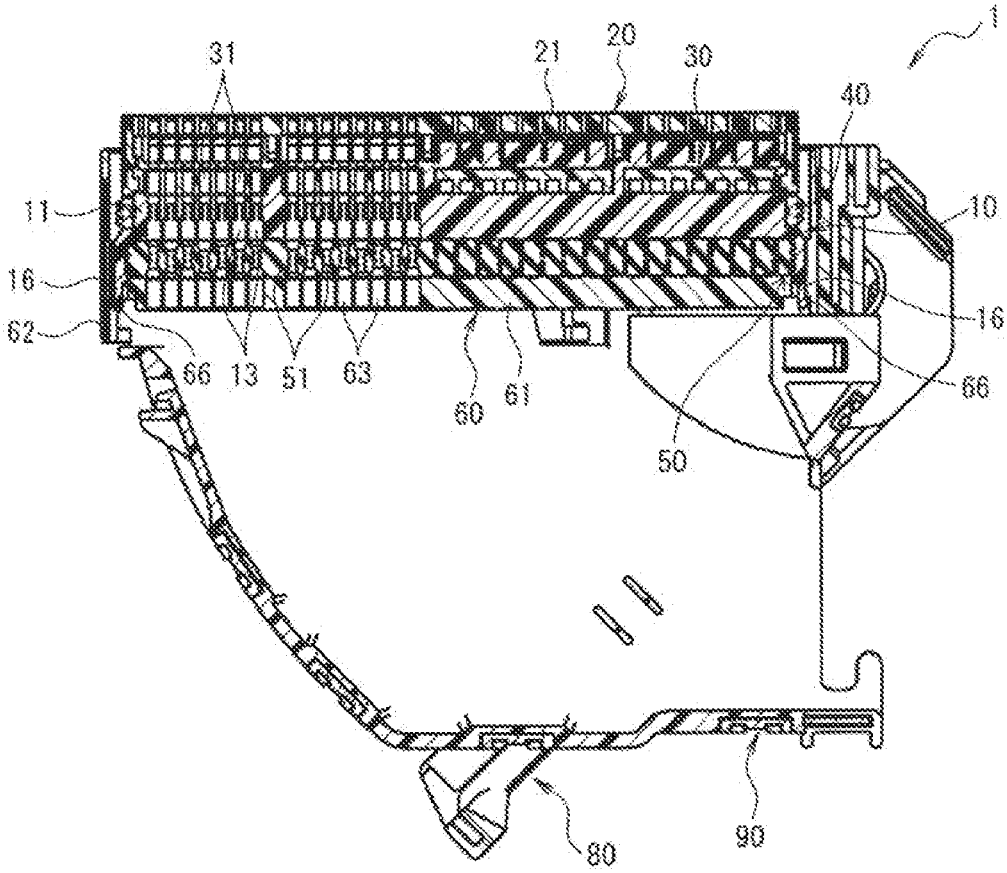
Figure 4A:
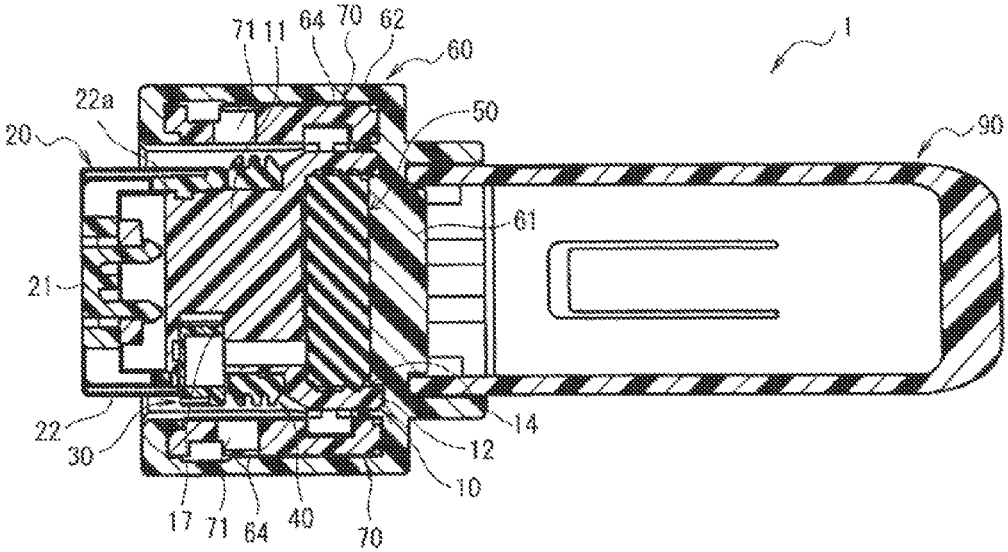
FIG. 4A is a cross-sectional view of the lever-type connector in FIG. 3A taken along a line 4A-4A.
Figure 4B:
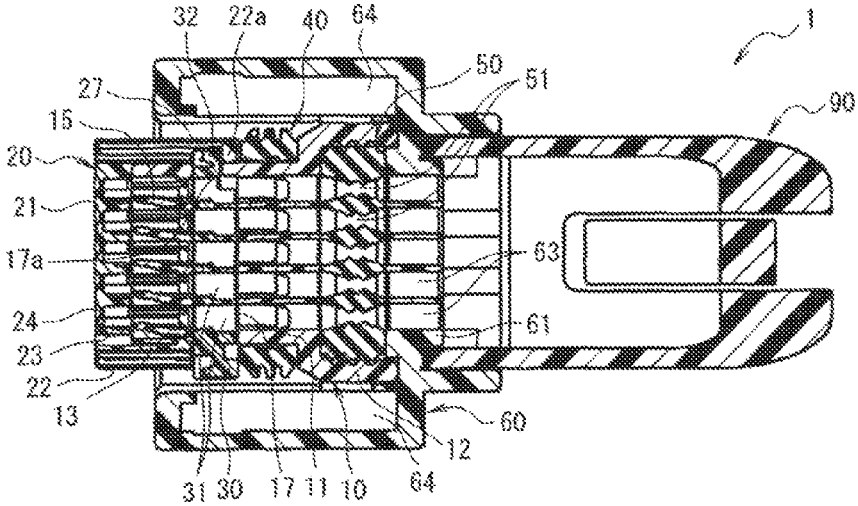
FIG. 4B is a cross-sectional view of the lever-type connector in FIG. 3A taken along a line 4B-4B.
Figure 5:
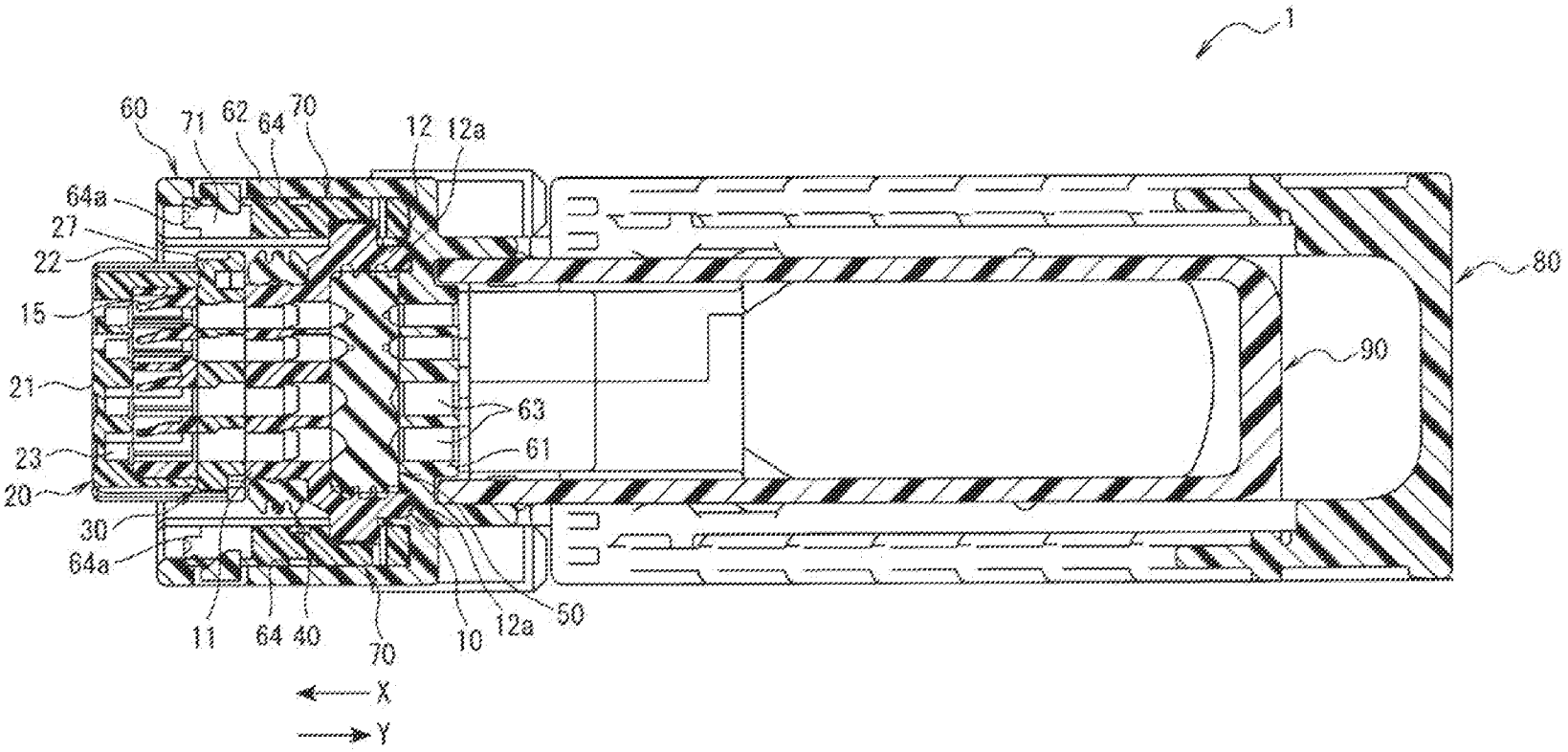
FIG. 5 is a cross-sectional view of the lever-type connector taken along a line 5-5 of FIG. 3A, and illustrates a state where a retainer is positioned at a proper locking position.

The inner housing 10 is integrally formed by molding an insulating resin, and, as shown in FIG. 3 to FIG. 5, includes: a housing main body 11 having a substantially rectangular parallelepiped shape and extending in the widthwise direction (left-right direction in FIG. 3A), in the up-down direction (up-down direction in FIG. 3A), and in the front-rear direction (up-down direction in FIG. 3B); and a hood 12 extending rearward from the housing main body 11. The housing main body 11 includes multiple contact receiving passageways 13 penetrating there through in the front-rear direction. The inner space of the hood 12 forms a second sealing member receiving space 14. Each of the contact receiving passageways 13 includes a housing lance 15 for primarily locking the contact (not illustrated).

Moreover, the housing main body 11 includes a retainer receiving depressed portion 17 that opens to the bottom surface thereof and that extends upward, as shown in FIG. 4B. The top surface of the retainer receiving depressed portion 17 includes multiple openings 17*a*, as shown in FIG. 1 and FIG. 4B. Front cover holding projections 32 of the retainer 30 can be penetrated through to the upper side of the housing main body 11 through openings 17*a*.

Additionally, a pair of latch arms 16 for latching the outer housing 60 to the inner housing 10 are formed to project rearward at both end portions in the widthwise direction of the hood 12 of the inner housing 10.

Furthermore, the front cover 20 is configured to be attached to the front side of the inner housing 10, and, as shown in FIG. 1, includes a cover main body 21 that extends in the widthwise direction for covering the front surface of the housing main body 11. The front cover 20 is formed by molding an insulating resin. Specifically, the rear surface of the cover main body 21 includes a hood 22 that extends rearward for covering the top surface of the housing main body 11, the bottom surface thereof, and both side surfaces thereof in the widthwise direction.

In this situation, the rear surface of the cover main body 21 of the front cover 20 includes, as shown in FIG. 4B and FIG. 5, the multiple contact receiving chambers 23 at positions corresponding to the multiple contact receiving passageways 13, respectively, positioned at the housing main body 11. The front surface of the cover main body 21 is positioned with multiple mating contact inserting holes 24 communicating with the contact receiving chambers 23 at positions corresponding to the contact receiving passageways 13 positioned at the housing main body 11, respectively.

By the provision of the front cover 20, it is possible to prevent a problem that the mating contacts (not illustrated) positioned along the mating connector 400 are brought into contact with the contacts of the lever-type connector 1, when the mating connector 400 (see FIG. 1 and FIG. 8) are mated with the lever-type connector 1.

That is, it is possible to protect the contacts received in the inner housing 10.

Moreover, a top wall 22*a* of the hood 22 of the front cover 20 includes multiple holes 27 into which the front cover holding projections 32 of the retainer 30 are inserted, as will be described later. As shown in FIG. 4B, when the retainer 30 is attached to the inner housing 10, each of the holes 27 is inserted through by each of the front cover holding projections 32 of the retainer 30 to restrict the movement in the front-rear direction of the front cover 20.

Subsequently, in the embodiment shown, the retainer 30 attaches from the bottom side of the inner housing 10 into the retainer receiving depressed portion 17. As shown in FIG. 1, FIG. 4A, and FIG. 4B, the retainer 30 has a substantially plate shape extending in the widthwise direction. The retainer 30 is temporarily held by the inner housing 10 at a temporary locking position shown in FIG. 4A and FIG. 4B, and is further pushed into and secured to the inner housing 10 at a proper locking position, as shown in FIG. 5A. The proper locking position of the retainer 30 represents a state where the retainer 30 is fully pushed inward. The retainer 30, as shown in FIG. 4B, includes multiple contact insertion passageways 31 positioned to correspond with the contact receiving passageways 13, respectively, positioned at the housing main body 11.

Then, a top end surface 30*a* of the retainer 30 is formed with the multiple front cover holding projections 32 to project upward.

Then, when the retainer 30 is positioned to the temporary locking position, contacts, not shown, are inserted into the contact receiving passageways 13, so the contacts are primarily locked by the housing lance 15. Subsequently, when the retainer 30 moves to the proper locking position, the contacts are secondarily locked by the retainer 30.

Additionally, the first sealing member 40 is has a ring shape, as shown in FIG. 1 and FIG. 4, to be in a close contact with the outside of the housing main body 11 of the inner housing 10. When the mating connector 400 mates with the lever-type connector 1, the first sealing member 40 seals a gap between the mating connector 400 and the housing main body 11 and prevents water from entering from the mating portion into the inner housing 10.

Furthermore, the second sealing member 50 is so-called family sealing member. As shown in FIG. 1 and FIG. 4A, the second sealing member 50 has a substantially plate shape to be housed in the second sealing member receiving space 14 of the hood 12 of the inner housing 10 and be in a close contact with the inner perimeter surface of the hood 12. The second sealing member 50 is formed with multiple electrical wire insertion passageways 51 at positions corresponding to the contact receiving passageways 13, as shown in FIG. 1 and FIG. 4A. The electrical wires (not shown), connected to the contacts in the contact receiving passageways 13, are extracted rearward through the electrical wire insertion passageways 51, respectively. A sealing portion at the internal periphery of the electrical wire insertion passageway 51 is in a close contact with the outer circumferential surface of the electrical wire so as to prevent water entering from the electrical wire insertion passageway 51 into the inner housing 10.

Moreover, the outer housing 60 attaches along the rear side of the inner housing 10 to prevent the second sealing member 50 from dropping off, and is formed as a single member by molding an insulating resin.

The outer housing 60 has a substantially rectangular parallelepiped shape extending in the widthwise direction, in the front-rear direction, and in the up-down direction, as shown in FIG. 1. The outer housing 60 includes: as shown in FIG. 4A, a main body 61 extending in the widthwise direction and positioned at the rear side of the second sealing member 50; and a hood 62 extending frontward from a peripheral edge of the main body 61 and covering the inner housing 10. The main body 61 of the outer housing 60 is positioned with multiple electrical wire extracting holes 63 at positions corresponding to the contact receiving passageways 13, respectively, as shown in FIG. 4B. In addition, a pair of slider receiving slots 64 extending in the widthwise direction are positioned at both of upper and lower sides of the hood 62 of the outer housing 60. Furthermore, the rear surface of the outer housing 60 includes a latching step 66 to be latched by the latch arm 16 positioned along the inner housing 10, as shown in FIG. 3B. Moreover, an end portion in the widthwise direction of the hood 62 of the outer housing 60 includes a pin receiving portion 65 into which a spindle portion 84, to be described later, of the lever 80 is fit.

Specifically, each of the sliders 70 is formed to have a substantially plate shape by molding an insulating resin, and is slidable in the widthwise direction in the slider receiving slot 64 of the outer housing 60. Cam grooves 71*a* to 71*c*, into which the cam pins 411*a* to 411*c* (see FIG. 1 and FIG. 8) positioned along the mating connector 400 are inserted, respectively, are positioned at an inner surface of each of the sliders 70. A depressed portion 72, into which a slider moving projection 85, to be described later, positioned along the lever 80 is fit, is positioned along one end of the inner surface of each of the sliders 70.

Additionally, as shown in FIG. 1, the lever 80 includes a pair of arms 81, and a joint portion 82 for jointing one ends of the arms 81.

The other end of each of the arms 81 includes an extending portion 83 extending perpendicularly to the arm portion 81, and an inner surface of an end of each extending portion 83 is formed with the spindle portion 84 in a projecting manner. Moreover, an outer surface of the other end portion of each arm portion 81 is formed with the slider moving projection 85 to be fit into the depressed portion 72 of each of the sliders 70 in a projecting manner.

Figure 2A:
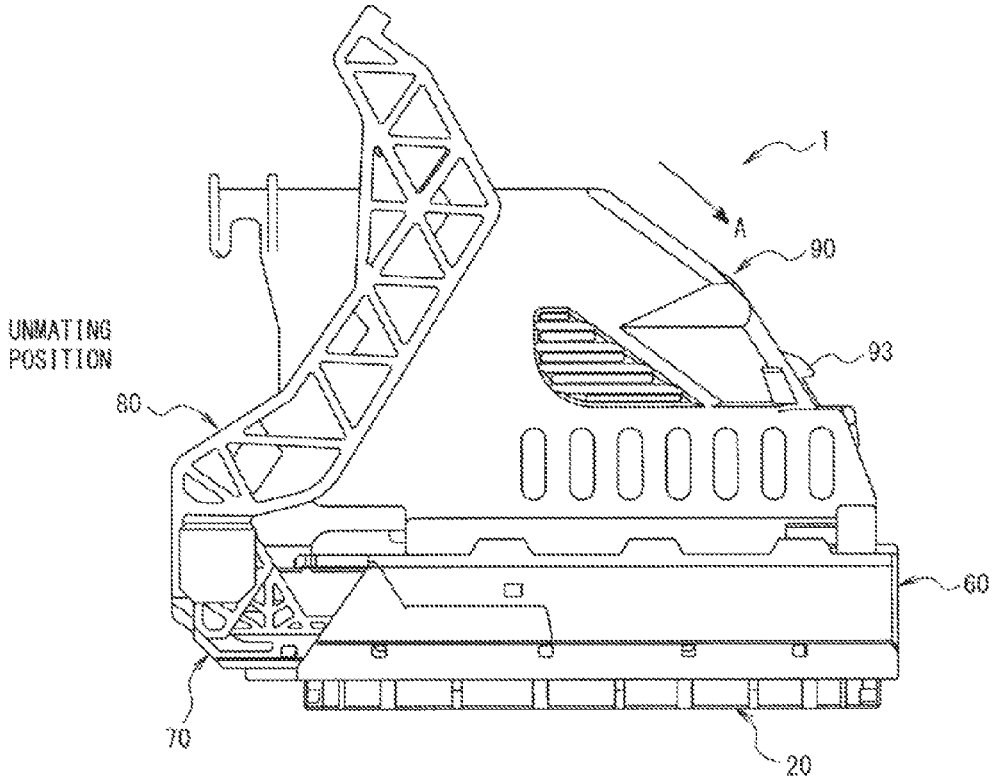
FIG. 2A is a side view of the lever-type connector of FIG. 1, where a lever is positioned at an unmated position
Figure 2B:
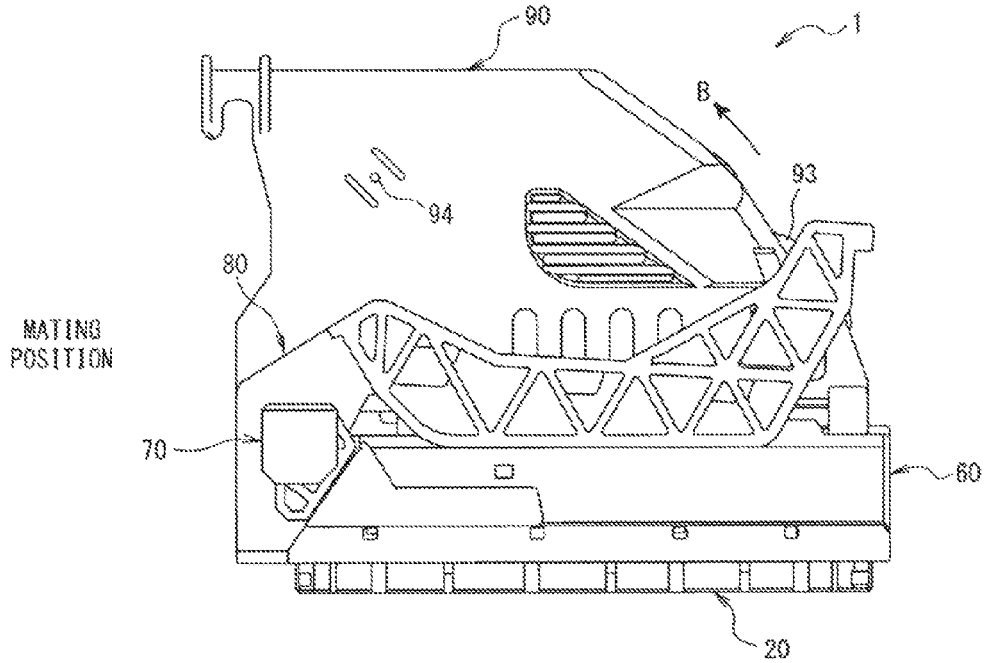
FIG. 2B is a side view of the lever-type connector of FIG. 1, where the lever is positioned at a mated position.

The spindle portion 84 of the lever 80 fits into the pin receiving portion 65 positioned along one end in the widthwise direction of the outer housing 60 so as to rotate in both directions including an arrow A direction indicated in FIG. 2A and an arrow B direction indicated in FIG. 2B, with respect to the outer housing 60. When the lever 80 rotates in the arrow A direction from the unmated position indicated in FIG. 2A to the mated position indicated in FIG. 2B, the slider moving projection 85 positioned along the lever 80 pushes the sliders 70. This causes the sliders 70 to interlock with the lever 80 and slides in a direction to be received in the slider receiving slots 64. The actions of the cam grooves 71*a* to 71*c* and the cam pins 411*a* to 411*c* cause the lever-type connector 1 and the mating connector 400 to be pulled to each other, thereby leading to a mating state. Conversely, when the lever 80 rotates in the arrow B direction from the mated position to the unmated position, the sliders 70 interlock with the lever 80 and slides in a direction of getting out of the slider receiving slots 64. The actions of the cam grooves 71*a* to 71*c* and the cam pins 411*a* to 411*c* cause the lever-type connector 1 and the mating connector 400 to be separated from each other. Such mating and unmating operations will be described later in detail.

Figure 6A:
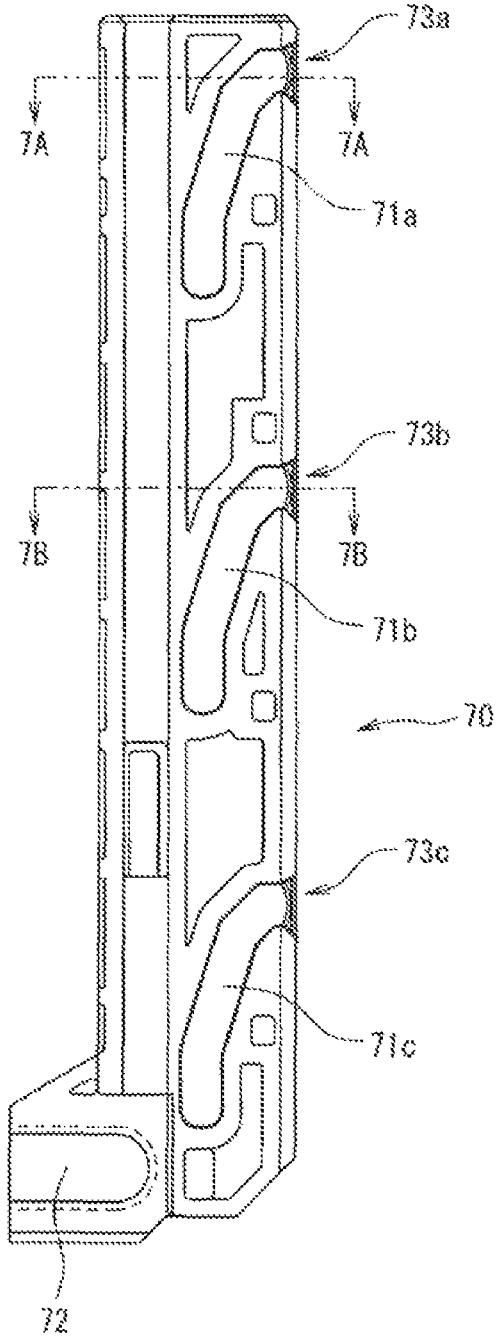
FIG. 6A is a bottom view of a slider installed at an upper side of the lever-type connector according to the invention.
Figure 6B:
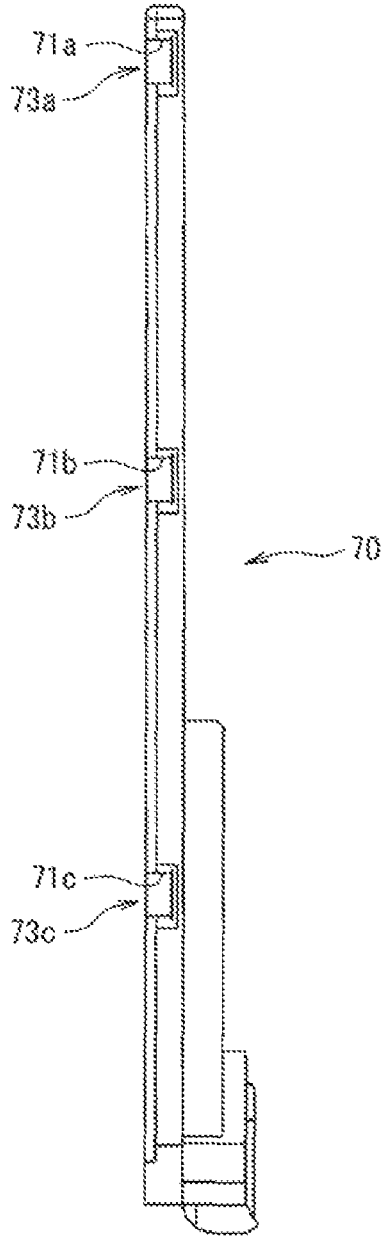
FIG. 6B is a front view of a slider installed at an upper side of the lever-type connector according to the invention.
Figure 7A:
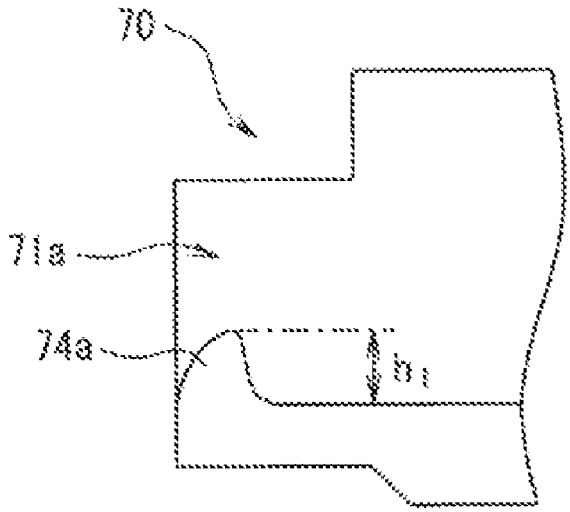
FIG. 7A illustrates a cross-sectional view of the slider of FIG. 6, taken along a line 7A-7A of FIG. 6A.
Figure 7B:
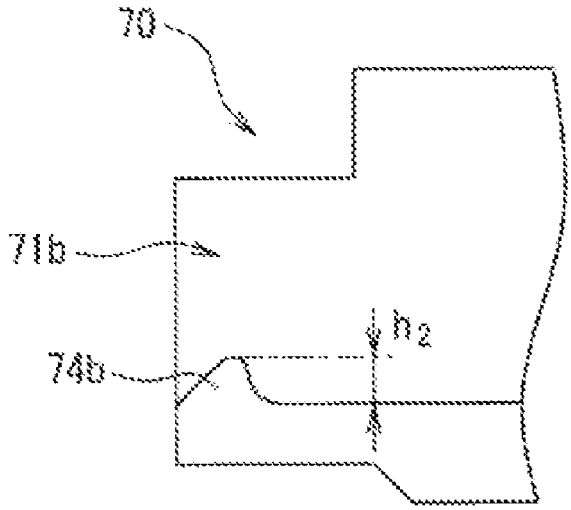
FIG. 7B is a cross-sectional view of the slider taken along a line 7B-7B of FIG. 6A.

Hereupon, as shown in FIG. 6A and FIG. 6B, the bottom surface of the slider 70 accommodated in the slider receiving slot 64 on the upper side includes multiple lines of cam grooves 71*a* to 71*c* at equal spaces in the lengthwise direction. Such multiple cam grooves 71*a* to 71*c* are formed to correspond to the cam pins 411*a* to 411*c* to be fit thereinto. In FIG. 6A, three lines of cam grooves are positioned. To correspond to each of the first cam pins 411*a*, 411*b*, and 411*c* to be fit into, positioned from the opposite side of the depressed portion 72 are the cam grooves 71*a*, 71*b*, and 71*c*. That is, the first cam groove 71*a* corresponds to the first cam pin 411*a* positioned at the side with a longer distance from a side surface end portion 410*b* of the mating portion 410. In each of the cam grooves 71*a*, 71*b*, and 71*c*, one side is closed and the other side is opened at the front surface of the slider 70 to form cam pin insertion opening portions 73*a* to 73*c* for receiving the cam pins 411*a*, 411*b*, and 411*c*, respectively. The cam pin insertion opening portions 73*a*, 73*b*, 73*c* of the cam grooves 71*a*, 71*b*, and 71*c* each have temporary mating projections 74*a* and 74*b*, as shown in FIG. 7A and FIG. 7B. A height $h_1$ of the temporary mating projection 74*a* (the height from the bottom surface of the cam groove 71*a* to the top of the temporary mating projection 74*a*) is made higher than a height $h_2$ of the temporary mating projection 74*b* (the height from the bottom surface of the cam groove 71*b* or 71*c* to the top of the temporary mating projection 74*b*).

Additionally, the temporary mating projections 74*a* and 74*b* are formed to have a cross section of a curved surface on the side into which the cam pins 411*a* to 411*c* are inserted, so that the cam pins 411*a* to 411*c* can be easily inserted there into even if they have prescribed heights, respectively.

Specifically, as in the above-described sliders 70, multiple lines of cam grooves 71*a* to 71*c* are positioned, on the plane of the slider 70 to be received in the slider receiving slots 64 on the lower side, at equal spaces in the lengthwise direction. These sliders 70 are received in the slider receiving slots 64 on the upper and lower sides to oppose the cam grooves 71*a* to 71*c* to each other, respectively.

Furthermore, the wire cover 90 is attached at the rear side of the outer housing 60 to extract multiple electrical wires extracted from the electrical wire extracting holes 63 of the outer housing 60, respectively, to one side in the widthwise direction of the outer housing 60. The top surface and the bottom surface of the wire cover 90 are each provided with a first regulating projection 94 for regulating the rotation of the lever 80 in the arrow A direction from the unmated position, as shown in FIG. 1, FIG. 2A and FIG. 2B. In addition, the top surface and the bottom surface of the wire cover 90 each are provided with a second regulating projection (not illustrated) for regulating the rotation of the lever 80 in the arrow A direction from the unmated position and in the opposite direction thereto, as shown in FIG. 1, FIG. 2A and FIG. 2B. Furthermore, the wire cover 90 includes a lock member 93 for preventing the lever 80 from rotating in the arrow B direction, when the lever 80 rotates in the arrow A direction and is positioned to the mated position, as shown in FIG. 1 and FIG. 2B.

Next, the assembling method of the lever-type connector 1 will be described.

In assembling the lever-type connector 1, firstly, the first sealing member 40 is attached to the outside of the housing main body 11 of the inner housing 10.

Next, the front cover 20 is attached to the front side of the inner housing 10.

Then, the retainer 30 is inserted into the retainer receiving depressed portion 17 from the bottom side of the housing 10, and is locked at the temporary locking position as shown in FIG. 4A and FIG. 4B. When the retainer 30 is positioned at the temporary locking position, contact insertion passageways 31 are positioned in alignment with the corresponding contact receiving passageways 13 of the inner housing 10, respectively. Moreover, in this situation, the front cover holding projections 32 of the retainer 30 penetrate through the opening 17*a* of the housing 10, and insert through the holes 27 of the front cover 20, thereby regulating the movement in the front-rear direction of the front cover 20.

Next, the second sealing member 50 is positioned in the second sealing member receiving space 14 of the hood 12 from the rear side of the inner housing 10. This brings the outer peripheral surface of the second sealing member 50 into a close contact with the inner peripheral surface of the hood 12.

Then, the outer housing 60 is attached from the rear side of the inner housing 10 to which the first sealing member 40, the front cover 20, the retainer 30, and the second sealing member 50 are already installed. In this situation, the latch arm 16 positioned at the inner housing 10 is latched at the latching step 66 of the outer housing 60. This prevents the second sealing member 50 from dropping off from the second sealing member receiving space 14. Additionally, the front cover 20 and the retainer 30 prevent the first sealing member 40 from dropping off from the inner housing 10.

Then, a pair of sliders 70 are inserted into the slider receiving slots 64 of the outer housing 60 from the edge on the opposite side of the depressed portion 72 positioned at one end thereof.

Subsequently, multiple contacts connected to the electrical wires are accommodated in the contact receiving passageways 13 of the inner housing 10 from the rear side of the outer housing 60 through the electrical wire extracting holes 63 and the electrical wire insertion passageways 51 of the second sealing member 50.

In this situation, the housing lance 15 positioned at the inner housing 10 primarily locks each of the contacts.

After that, the retainer 30 at the temporary locking position is pushed into the proper locking position. Then, the contacts are secondarily locked by the retainer 30. At this time, the front cover holding projections 32 of the retainer 30 that have passed through the holes 27 of the front cover 20 regulate the movement in the front-rear direction of the front cover 20.

Next, the wire cover 90 is attached at the rear side of the outer housing 60, and multiple electrical wires extracted from the electrical wire extracting holes 63 of the outer housing 60 are extracted to one side in the lengthwise direction of the outer housing 60.

Finally, the spindle portion 84 of the lever 80 is inserted into the pin receiving portion 65 positioned at one end in the widthwise direction of the outer housing 60, and simultaneously the slider moving projection 85 of the lever 80 is inserted into the depressed portion 72 of each of the sliders 70. This permits the lever 80 to be rotatable in both of the arrow A direction illustrated in FIG. 2A and the arrow B direction illustrated in FIG. 2B with respect to the outer housing 60, and in addition, permits the sliders 70 to be movable in the slider receiving slots 64 in conjunction with the rotational movement of the lever 80.

With the above operations, assembling of the lever-type connector 1 is completed.

Next, the actions of mating and unmating of the lever-type connector 1 and the mating connector 400 will be described with reference to FIG. 5, and FIG. 8 to FIG. 12.

Figure 8A:
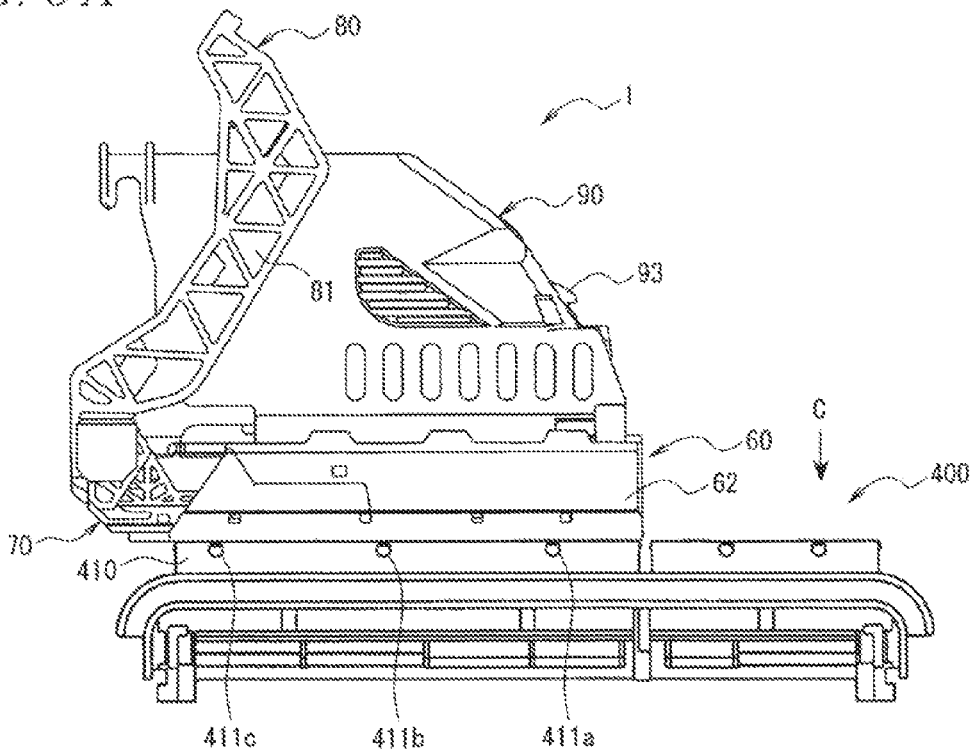
FIG. 8A to FIG. 8C are explanatory views illustrative of a mating state where the lever-type connector according to the invention mates with the mating lever-type connector.
Figure 8B:
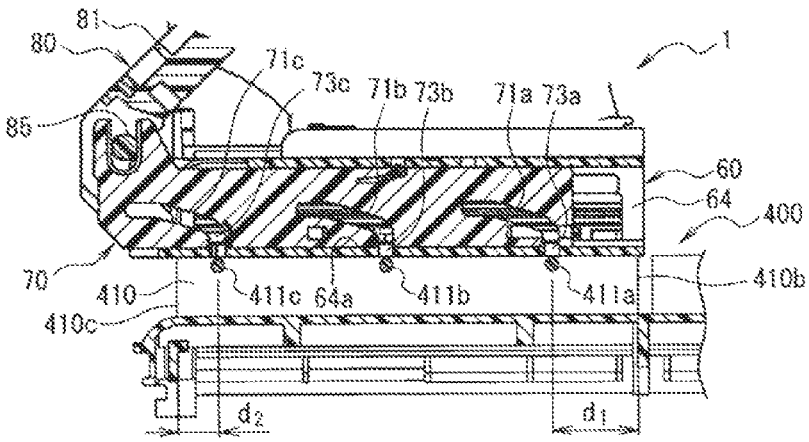
Figure 8C:
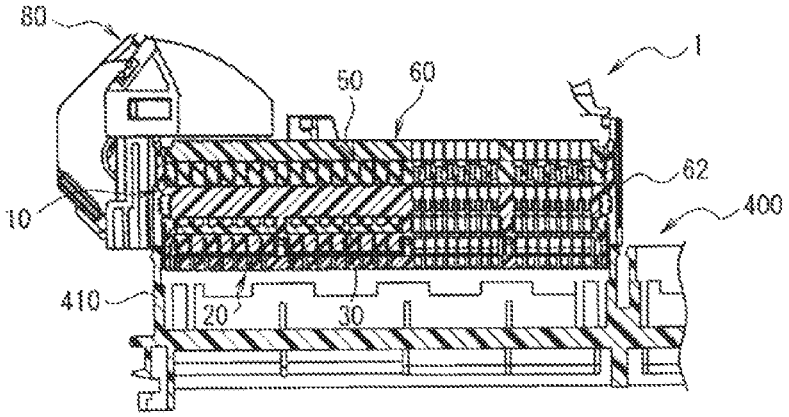
Figure 9A:
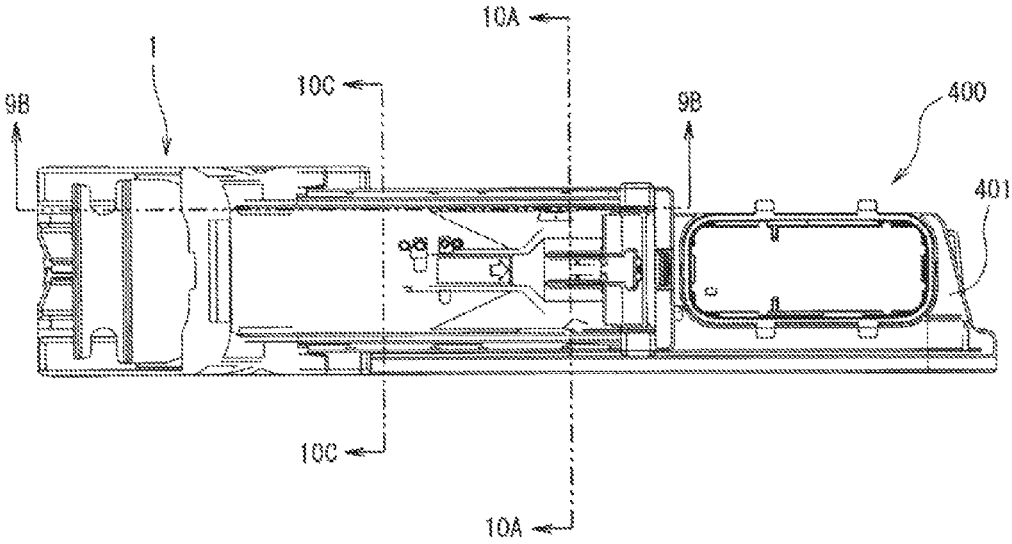
FIG. 9 is a rear view of the lever-type connector according to the invention, showing temporary mating state between the lever-type connector and the mating lever-type connector.
FIG. 9B is a cross-sectional view of the lever-type connector taken along a line 9B-9B of FIG. 9A.
Figure 9B:
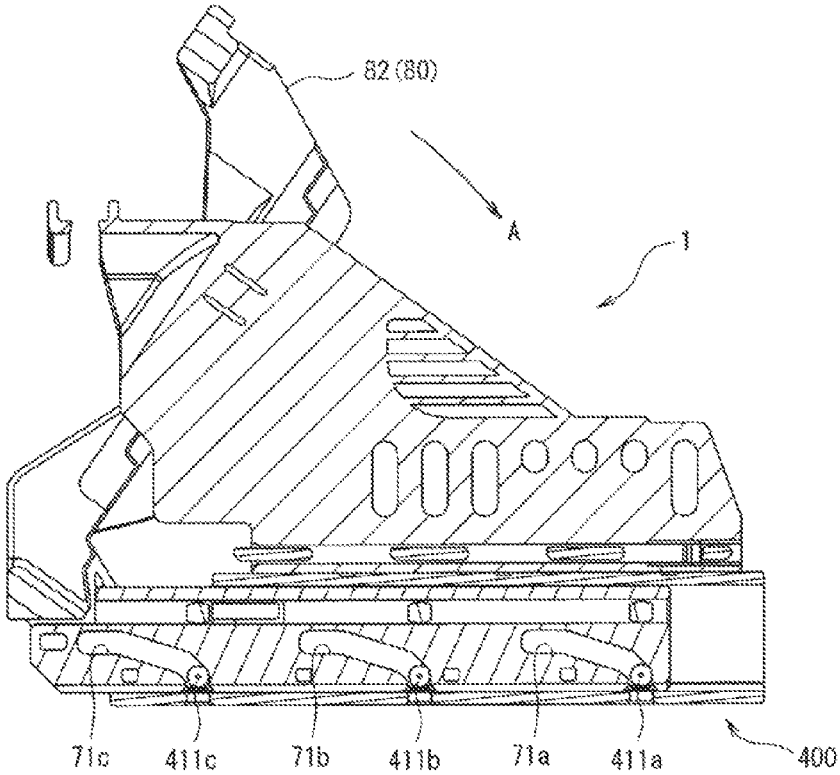

In order to assemble the lever-type connector 1 and the mating connector 400, firstly, the lever 80 and the sliders 70 are positioned at the unmated position, as shown in FIG. 8. In this state, the rotation in the arrow A direction of the lever 80, as shown in FIG. 9, is regulated by the first regulating projection 94 positioned at the wire cover 90. Next, in this state, the lever-type connector 1 is pushed into the front side of the mating connector 400 in an arrow C direction, as shown in FIG. 8. Then, the cam pins 411*a* to 411*c* positioned along the mating portion 410 of the mating connector 400 enter the cam pin insertion opening portions 73 of the cam grooves 71*a* to 71*c* positioned at the sliders 70, and the lever-type connector 1 and the mating connector 400 are brought into a temporary mating state.

Figure 10A:
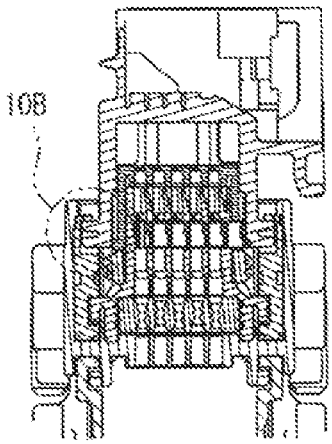
FIG. 10A is a cross-sectional view of the lever-type connector taken along a line 10A-10A of FIG. 9A.
Figure 10B:
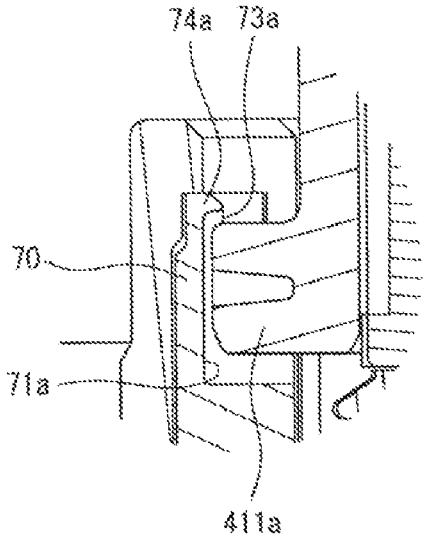
FIG. 10B is an enlarged view of the lever-type connector of FIG. 10A.
Figure 10C:
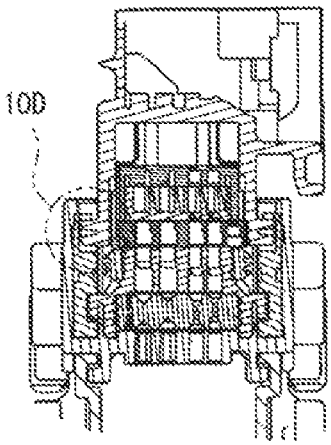
FIG. 10C is a cross-sectional view of the lever-type connector taken along a line 10C-10C of FIG. 9A.
Figure 10D:
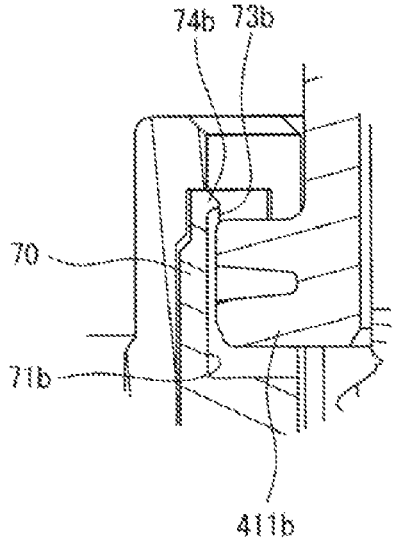
FIG. 10D is an enlarged view of the lever-type connector of FIG. 10C.

In such a temporary mating state, referring to FIG. 10A and FIG. 10B, the first cam pin 411*a* that has passed over the temporary mating projection 74*a* is mated in the periphery of the cam pin insertion opening portion 73*a* of the first cam groove 71*a*. Also, referring to FIG. 10C and FIG. 10D, the cam pin 411*b* that has passed over the temporary mating projection 74*b* is mated in the periphery of the cam pin insertion opening portion 73*b* of the cam groove 71*b*. In the shown embodiment, the temporary mating projection 74*a* is set higher than the other temporary mating projections 74*b* and 74*c*, thereby making it difficult for the cam pin 411*a* to pass over the temporary mating projection 74*a*. This makes it sure that in a case where the cam pin 411*a* passes over the temporary mating projection 74*a*, an inertial force makes the other second cam pins 411*b* and 411*c* pass over the other temporary mating projections 74*b* and 74*c*. That is to say, the inertial force exerted when the first cam pin 411*a* is temporarily fit temporarily fit the other second cam pins 411*b* and 411*c*, thereby making it possible to temporarily fit all the cam pins with certainty.

Figure 11A:
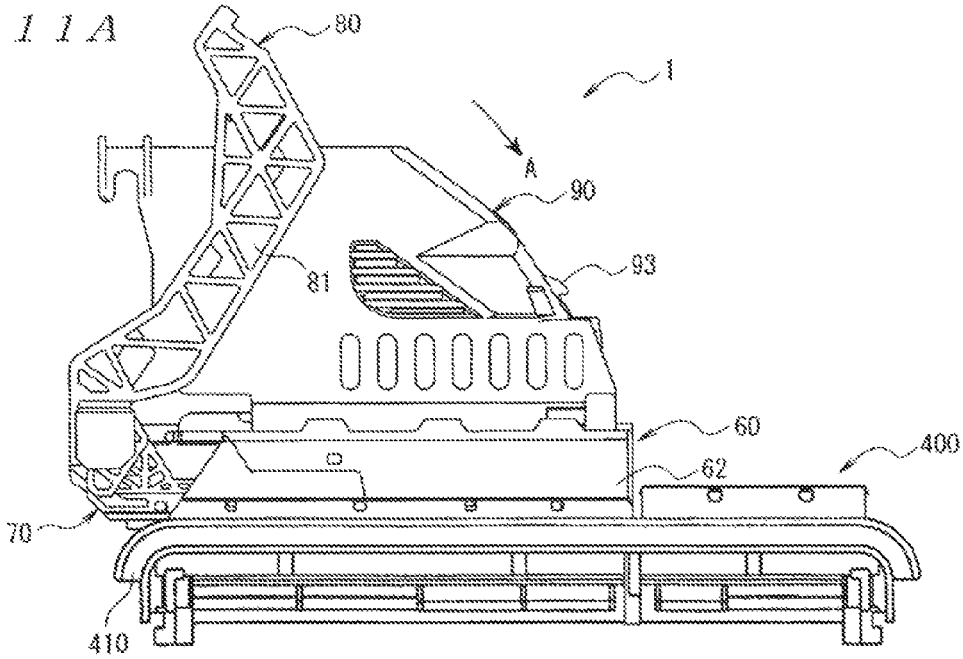
FIG. 11A-11C are explanatory views of lever-type connector according to the invention where the mating is being performed between the lever-type connector and the mating lever-type connector.
Figure 11B:
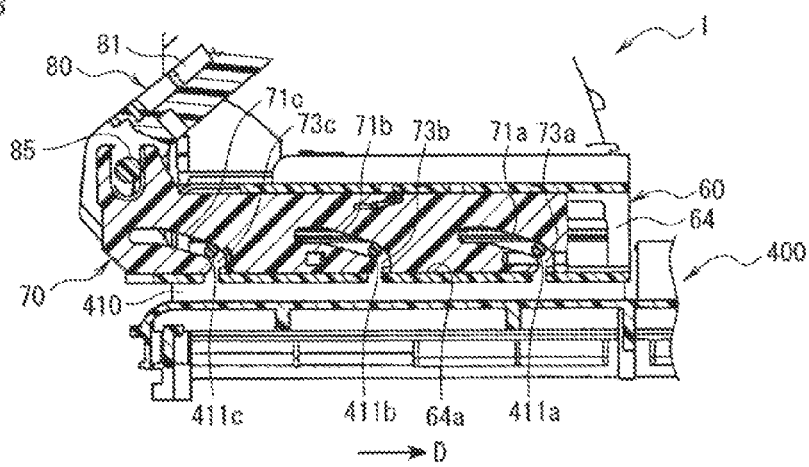
Figure 11C:
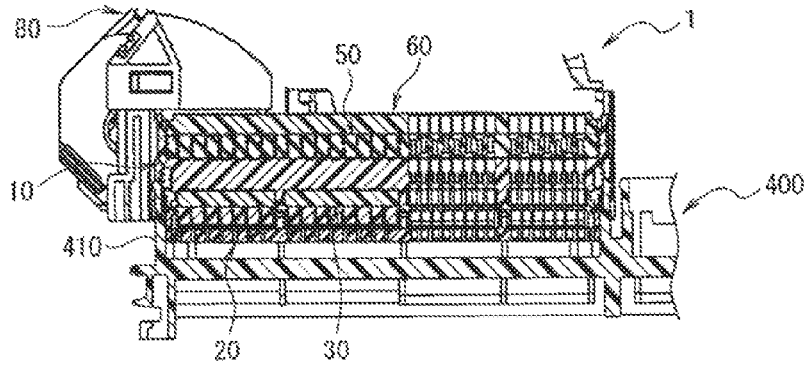

Then, when the lever 80 at the unmated position is rotated in the arrow A direction as shown in FIG. 9 with a force greater than the necessary one for releasing the regulation from the first regulating projection 94, the slider moving projection 85 positioned at the lever 80 pushes the sliders 70 in an arrow D direction, so that the sliders 70 and the lever 80 interlock for a sliding operation. This brings a state where the mating is being performed, as shown in FIG. 11. Accordingly, the actions of the cam grooves 71*a* to 71*c* positioned at the sliders 70 and the cam pins 411*a* to 411*c* positioned to the mating connector 400 cause the lever-type connector 1 and the mating connector 400 to be pulled to move closer to each other slightly.

Figure 12A:
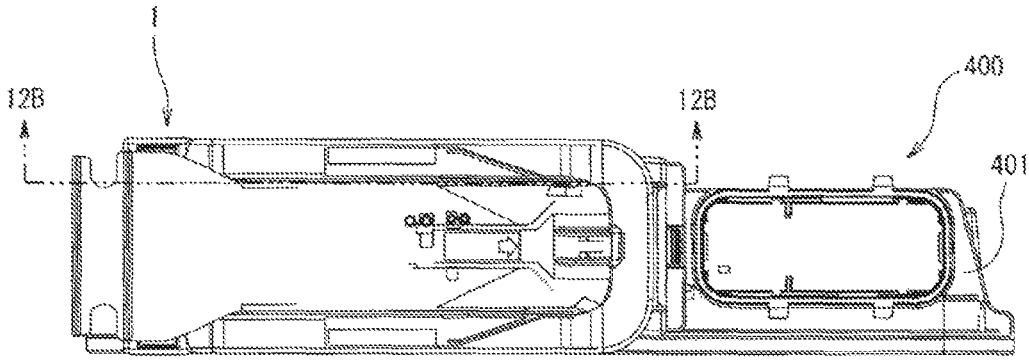
FIG. 12 is a rear view of the lever-type connector according to the invention where the mating has been completed between the lever-type connector and the mating lever-type connector.
FIG. 12B is a cross-sectional view of the lever-type connector taken along a line 12B-12B of FIG. 12A.
Figure 12B:
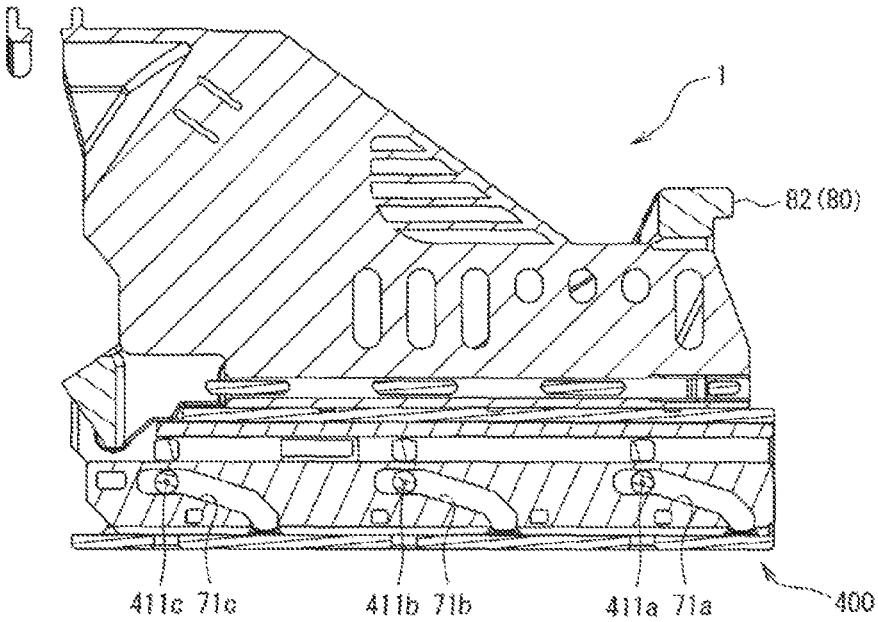
Figure 13:
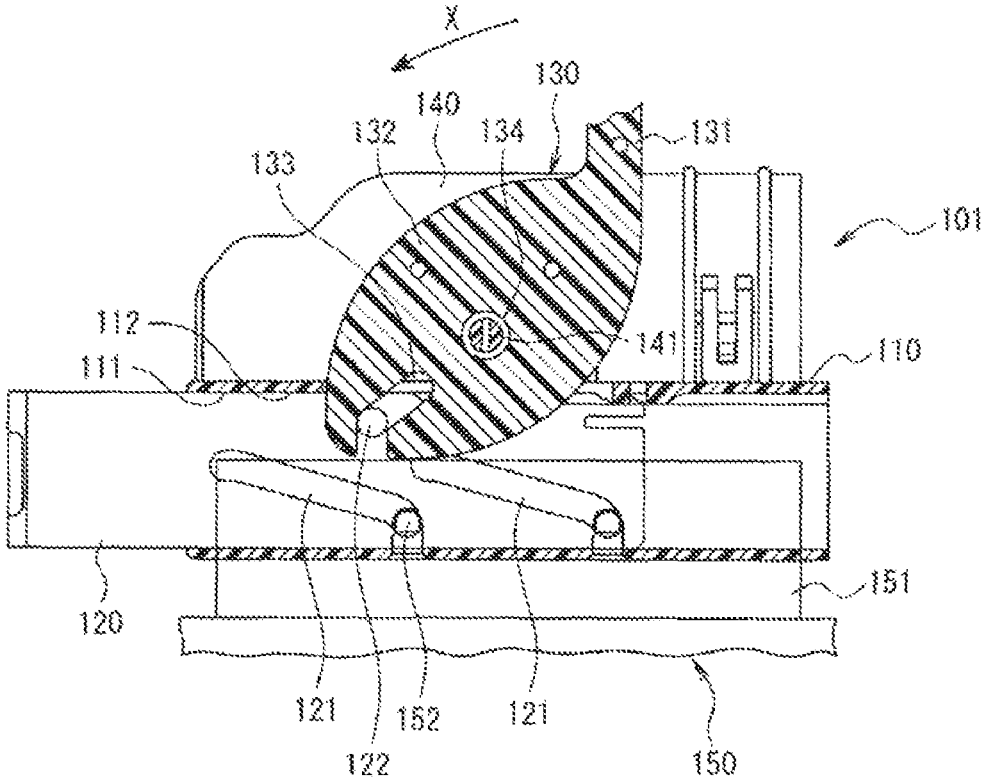
F I G. 1 3 PRIOR ART
FIG. 13 is a cross-sectional view of a known lever-type connector.
Figure 14:
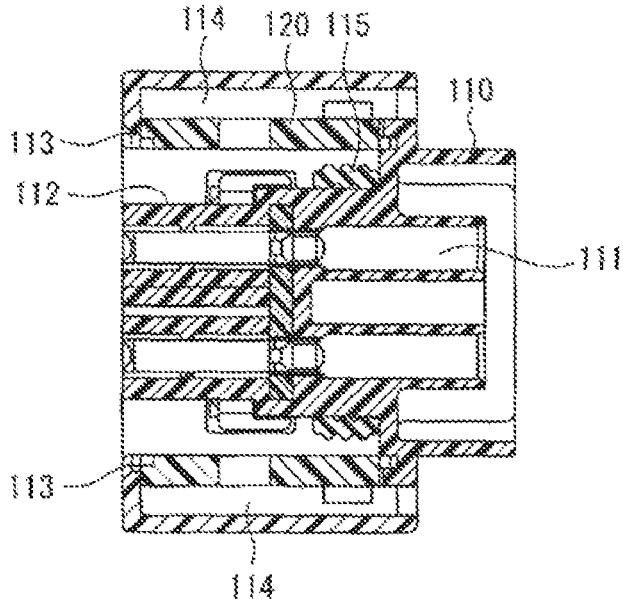
FIG. 14 PRIOR ART
FIG. 14 is a cross-sectional view of the known lever-type connector of FIG. 13.
Figure 15:
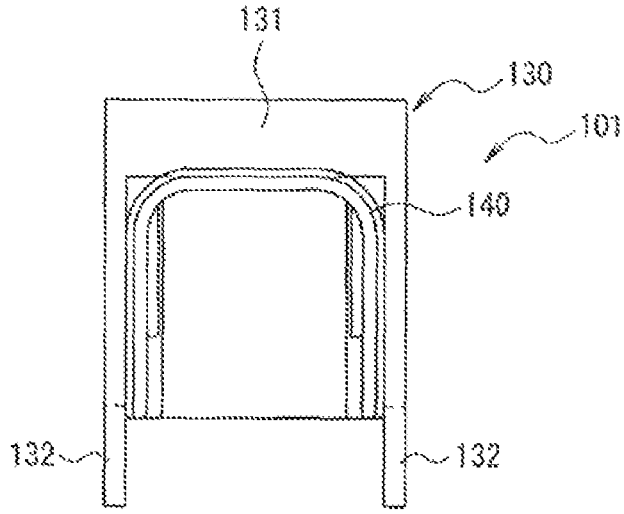
FIG. 15 PRIOR ART
FIG. 15 is an explanatory view of a wire cover and a lever of the known lever-type connector shown in FIG. 13.
Figure 16A:
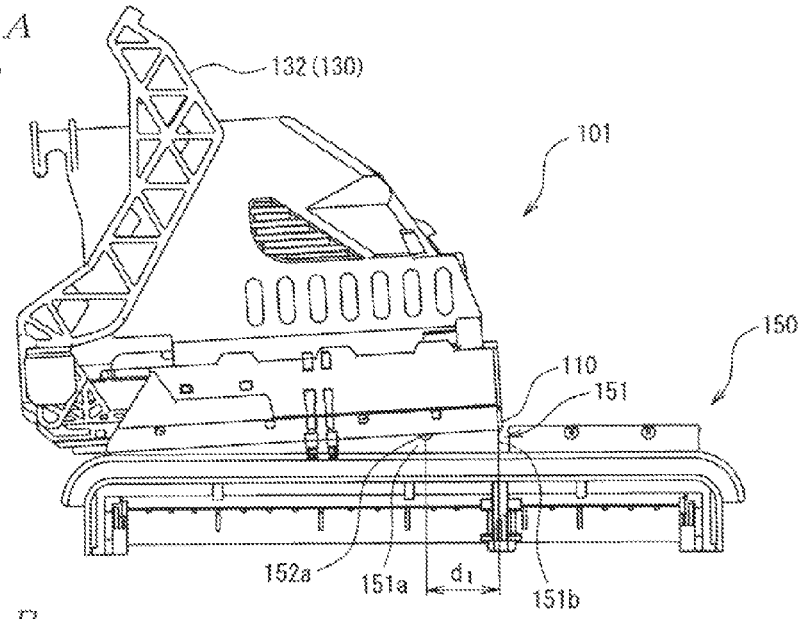
FIG. 16A PRIOR ART
FIG. 16A is plan view of the known lever-type connector where the known lever-type connector is mated with the mating lever-type connector with the conventional lever-type connector tilting toward a rear side of an arm portion of the lever.
Figure 16B:
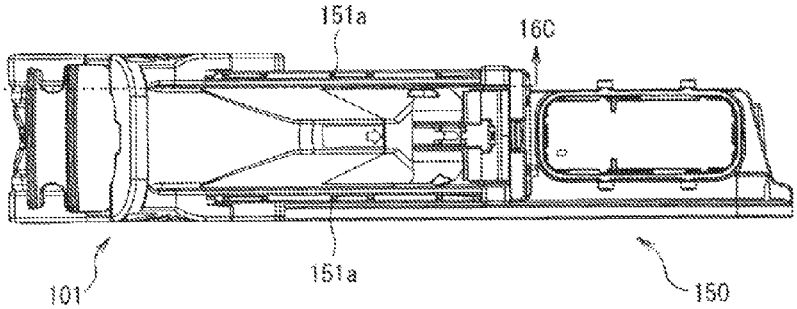
FIG. 16B PRIOR ART
FIG. 16B is a rear view of the known lever-type connector where the known lever-type connector is mated with the mating lever-type connector with the conventional lever-type connector tilting toward a rear side of an arm portion of the lever.
Figure 16C:
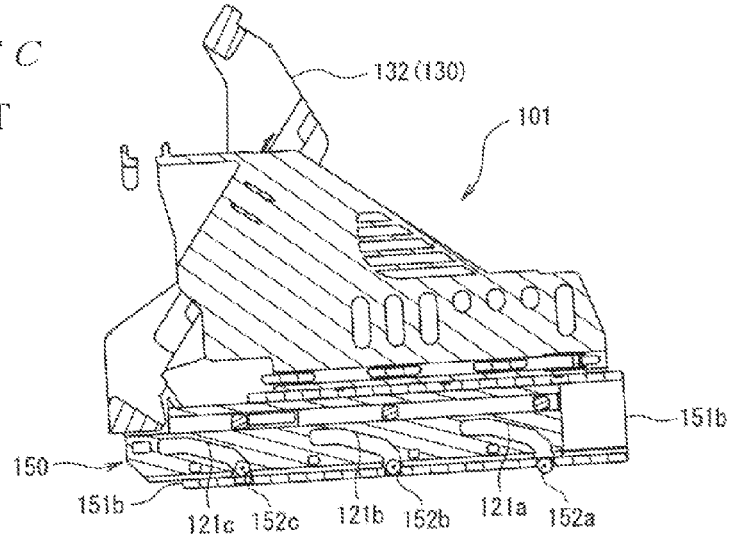
FIG. 16C PRIOR ART
FIG. 16C is a cross-sectional view of the known lever-type connector taken along a line 16C-16C of FIG. 16B.
Figure 17A:
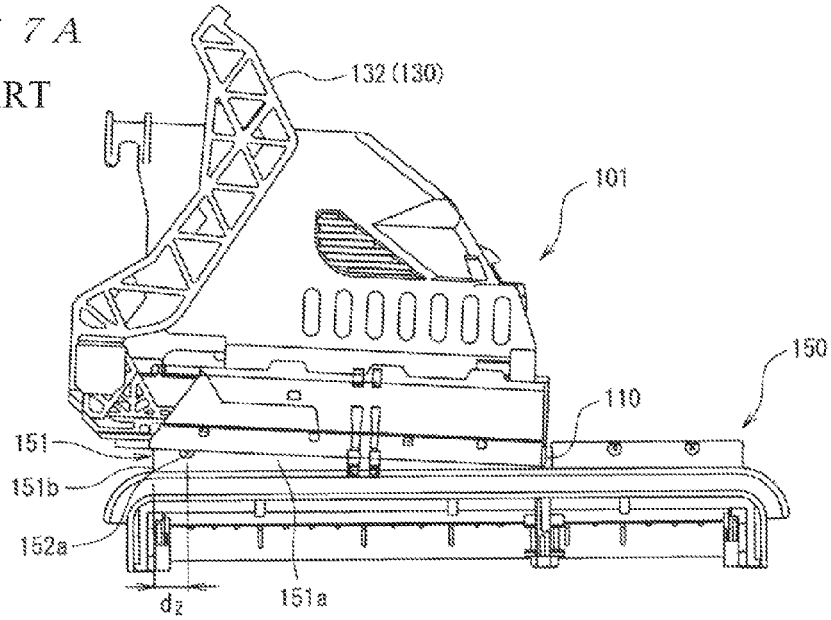
FIG. 17A PRIOR ART
FIG. 17A is plan view of the known lever-type connector where the known lever-type connector is mated with the mating lever-type connector with the known lever-type connector tilting toward an end side of the arm portion of the lever.
Figure 17B:
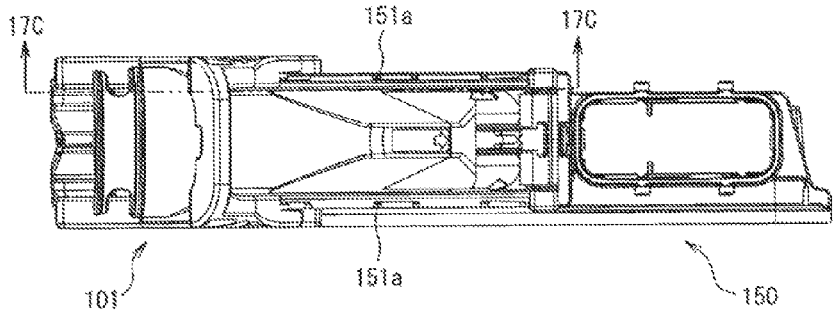
FIG. 17B PRIOR ART
FIG. 17B is a rear view of the known lever-type connector where the known lever-type connector is mated with the mating lever-type connector with the known lever-type connector tilting toward an end side of the arm portion of the lever.
Figure 17C:
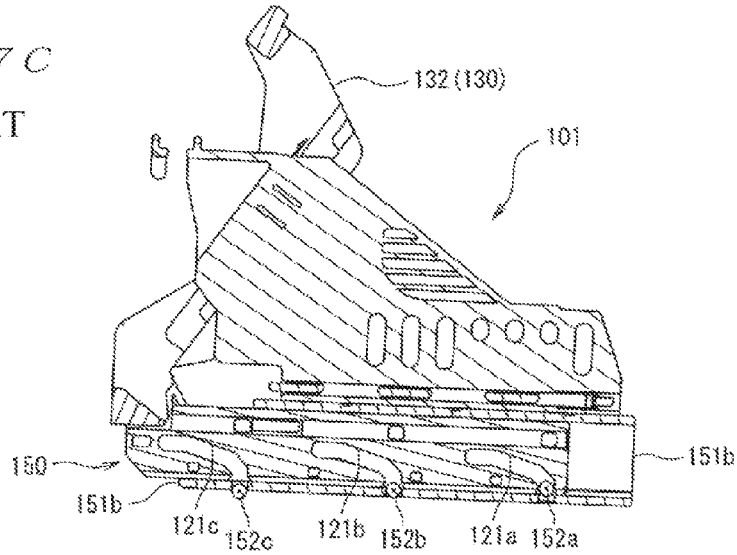
FIG. 17C PRIOR ART
FIG. 17C is a cross-sectional view take along a line 17C-17C of FIG. 17B.

Then, when the lever 80 is further rotated in the arrow A direction to be positioned to the mated position, the slider moving projection 85 positioned at the lever 80 further pushes the sliders 70 in the arrow D direction, so that the sliders 70 and the lever 80 interlock for a sliding operation. This brings a situation where the mating has been completed, as shown in FIG. 12. In this state, the actions of the cam grooves 71*a* to 71*c* positioned at the sliders 70 and the cam pins 411*a* to 411*c* positioned to the mating connector 400 cause the lever-type connector 1 and the mating connector 400 to be pulled to the final positions with each other. This completes the mating operation between the lever-type connector 1 and the mating connector 400. When the lever 80 is positioned to the mated position, the rotation of the lever 80 in the arrow B direction illustrated in FIG. 2B is prevented by the lock member 93.

In this manner, according to the lever-type connector 1, among the cam pins positioned to the mating portion 410, the height $h_1$ of the temporary mating projection 74*a* of the first cam groove 71*a* corresponding to the first cam pin 411*a* positioned at the side having a longer distance from the side surface end portion is configured higher than the height $h_2$ of the temporary mating projections 74*b* and 74*c* of the other cam grooves 71*b* and 71*c*. With such a configuration, the inertial force exerted when the first cam pin 411 is temporarily fit into the cam groove 71*a* causes the other second cam pins 411*b* and 411*c* to be temporarily fit into the cam grooves 71*b* and 71*c*, respectively, with certainty. Accordingly, a situation where the outer housing 60 could obliquely mate with the mating portion 410 is averted and all the cam pins 411*a* to 411*c* properly fit into the cam grooves 71*a* to 71*c*. It is therefore possible to provide the lever-type connector 1 that enables proper mating without twisting mating.

Heretofore, the embodiments of the invention have been described. However, the present invention is not limited to these embodiments, and may have variations and modifications. For example, among multiple cam pins positioned to the mating portion, when the distance of the can pins at both ends from the side surface portion of the mating portion are same with each other, the heights of the temporary mating projections of the cam grooves corresponding to the cam pins on both ends may be configured higher than the heights of the temporary mating projections of the cam grooves corresponding to the cam pins other than those on both ends.

Additionally, it is to be noted that the present invention is applicable to a sliding cam type connector without a lever, as described in Patent Document H06-11275 A, for example.

What is claimed is:

1. An electrical connector, comprising:

an inner housing;

an outer housing attached to the inner housing;

a slider receiving slot disposed in the outer housing;

a slider having a plurality of multiple cam grooves with a plurality of cam pin insertion openings, the slider slidably received in the slider receiving slot; and a plurality of temporary mating projections positioned along the plurality of cam pin insertion openings;

wherein a height of one of the plurality of temporary mating projections is higher than a height of another of the plurality of temporary mating projections.

2. The electrical connector according to claim 1, wherein the one of the plurality of temporary mating projections corresponds to one of a plurality of cam pins positioned farthest from an end surface of a mating connector.

3. The electrical connector according to claim 2, further comprising a lever being rotatably positioned on the outer housing to slide the slider.

4. The electrical connector according to claim 3, wherein a rotational operation of the lever draws the electrical connector to be mated or unmated with the mating connector.

5. The electrical connector according to claim 4, wherein the slider pulls the inner housing in a direction away from the mating connector, when the electrical connector is separated from the mating connector.

6. The electrical connector according to claim 1, wherein the plurality of temporary mating projections have a curved cross section on a side into which a plurality of cam pins are inserted.

7. The electrical connector according to claim 1, wherein the outer housing urges the inner housing in a direction closer to the mating connector when the connector is mated with the mating connector.

8. The electrical connector according to claim 7, wherein the outer housing urges the inner housing in a direction closer to the mating connector when the electrical connector is mated with the mating connector.

9. The electrical connector according to claim 1, further comprising a seal member receiving space in the inner housing.

10. The electrical connector according to claim 9, wherein the sealing member is substantially plate shaped and provided with a plurality of electrical wire insertion passageways.

11. The electrical connector according to claim 10, further comprising contact receiving passageways in the inner housing, the plurality of electrical wire insertion passageways of the sealing member corresponding to a position of the contact receiving passageways.

* * * * *